US008279034B2

(12) United States Patent
Kim et al.

(10) Patent No.: US 8,279,034 B2
(45) **Date of Patent: *Oct. 2, 2012**

(54) SLIM TYPE HIGH VOLTAGE TRANSFORMER

(75) Inventors: Jongseok Kim, Seoul (KR); Haksoo Lee, Asan-si (KR); Giju Han, Asan-si (KR); Miae Yun, Chuncheon-si (KR)

(73) Assignee: Kolonet, Gyeonggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/912,005

(22) Filed: Oct. 26, 2010

(65) Prior Publication Data

US 2011/0260817 A1 Oct. 27, 2011

(30) Foreign Application Priority Data

Apr. 23, 2010 (KR) ..... 10-2010-0037696

(51) Int. Cl.

| | |
|---|---|
| ***H01F 27/02*** | (2006.01) |
| ***H01F 27/30*** | (2006.01) |
| ***H01F 27/28*** | (2006.01) |
| ***H01F 17/04*** | (2006.01) |
| ***H01F 7/06*** | (2006.01) |

(52) U.S. Cl. ..... 336/90; 336/92; 336/199; 336/208; 336/170; 336/221; 336/222; 29/602.1; 29/606

(58) Field of Classification Search ..... 336/92, 336/90, 83, 145, 170, 182, 198, 199, 207, 336/208, 221, 222

See application file for complete search history.

(56) References Cited

U.S. PATENT DOCUMENTS

| | | | | |
|---|---|---|---|---|
| 4,675,638 | A * | 6/1987 | Szabo | 336/83 |
| 6,115,236 | A * | 9/2000 | Jedlitschka et al. | 361/600 |
| 2003/0095023 | A1* | 5/2003 | Markwardt | 336/90 |
| 2008/0186119 | A1* | 8/2008 | Zou | 336/92 |
| 2008/0204180 | A1* | 8/2008 | Aboumrad et al. | 336/92 |
| 2009/0027151 | A1* | 1/2009 | Nakatsu et al. | 336/212 |
| 2010/0328005 | A1* | 12/2010 | Sarver et al. | 336/150 |
| 2011/0260818 | A1* | 10/2011 | Kim et al. | 336/92 |

* cited by examiner

*Primary Examiner* — Mohamad Musleh
*Assistant Examiner* — Mangtin Lian
(74) *Attorney, Agent, or Firm* — IPLA P.A.; James E. Bame

(57) ABSTRACT

A slim-type high voltage transformer includes a case, and a transformer portion configured by mounting at least primary and secondary winding coils wound in the shape of a rectangular or elliptic track to protruding grooves formed in the interior of the case and then mounting a first copperplate core on the primary and secondary winding coils. In the transformer, the transformer portion further includes an insulating member interposed between the primary and secondary winding coils and the first copperplate core. Accordingly, a bobbin for winding a coil is not used, so that the height of the transformer can be minimized, thereby decreasing the size of products. Also, a winding is divided into two sections to be molded, so that the insulation and heat generation of the winding can be effectively controlled, thereby improving the stability of the transformer.

6 Claims, 6 Drawing Sheets

SLIM TYPE HIGH VOLTAGE TRANSFORMER

CROSS REFERENCE

This application claims foreign priority under Paris Convention and 35 U.S.C. §119 to Korean Patent Application No. 10-2010-0037696, filed Apr. 23, 2010 with the Korean Intellectual Property Office.

BACKGROUND OF THE INVENTION

1. Technical Field

An aspect of the present invention relates to a high voltage transformer, and more particularly, to a slim-type high voltage transformer in which a plurality of protruding grooves in place of a bobbin are formed in the interior of a case, and primary and secondary winding coils are mounted to the protruding grooves, thereby minimizing the height of the transformer.

2. Description of the Related Art

Recently, liquid crystal displays (LCDs) have been widely used not only for personal computers and notebook computers but also for office automation equipments such as photocopiers and portable devices such as cellular phones and beepers because they can be miniaturized as compared with cathode ray tubes (CRTs).

Since an LCD is not a self-luminescent display device, it requires a light source such as a backlight. The backlight is driven by an inverter, and consumes the most amount of power in the LCD.

Meanwhile, the inverter has a high voltage transformer to drive the backlight. The transformer functions to apply voltage to a lamp that constitutes an LCD panel by generating high AC output voltage with low AC input voltage.

The transformer resonates with the capacitance of the lamp and panel at the frequency applied to a primary side thereof, so that secondary voltage can be more increased than the turn ratio of primary and secondary windings. Therefore, the transformer may be referred to as a resonant transformer.

The transformer is generally manufactured by winding a primary coil at the low voltage side and a secondary coil at the high voltage side around a bobbin having a core inserted into a hollow portion thereof. One coil referred to as the primary coil is connected to an input circuit in which voltage is to be changed, and the other coil referred to as the secondary coil is connected to an output circuit in which the changed (transformed) voltage is used. When AC current of the input circuit passes through the primary coil, a magnetic field of which intensity and direction are changed is generated in response to the AC current. The change of magnetic flux induces AC voltage in the secondary coil, and the turn ratio of the primary and secondary coils determines a voltage transformation ratio.

A conventional transformer includes one bobbin having first and second coil winding portions around which primary and secondary coils are wound, respectively, a transformer cap into which the bobbin is inserted, and a pair of "E" shaped cores respectively inserted into insertion holes formed in the bobbin by passing through both side portions of the transformer cap.

In the case of such a small-sized high voltage transformer, the winding turns of a coil at the high voltage side are considerably greater than those of a coil at the low voltage side, and hence the current that flows in the coil at the high voltage side is much less than the current that flows in the coil at the low voltage side. Therefore, the thickness of the coil at the high voltage side is much thinner than that of the coil at the low voltage side.

However, since the conventional transformer described above is used by winding the primary and secondary coils around only one bobbin, the primary and secondary coils are necessarily spaced apart from each other at a certain spacing distance so as to secure a creepage distance necessary for insulation, and therefore, the winding area of the primary coil is partially wasted. Further, since the bobbin is used to allow the primary and secondary coils to be wound therearound, there is a limitation in decreasing the height of the bobbin. Therefore, there is a limitation in slimming the transformer.

SUMMARY OF THE INVENTION

Embodiments provide a slim-type high voltage transformer in which a plurality of protruding grooves in place of a bobbin are formed in the interior of a case, and primary and secondary winding coils are mounted to the protruding grooves, thereby minimizing the height of the transformer and increasing the efficiency of the transformer.

In another embodiment, there is provided a slim-type high voltage transformer including: a case; and a plurality of transformer portions configured by mounting a plurality of primary and secondary winding coils to protruding grooves formed in the interior of the case and then mounting a first copperplate core on the primary and secondary winding coils, wherein the plurality of transformer portions are disposed bilaterally symmetric, and share at least one copperplate core and an insulating member interposed between the primary and secondary winding coils and the copperplate core.

BRIEF DESCRIPTION OF THE DRAWINGS

The above and other aspects, features and advantages disclosed herein will become apparent from the following description of preferred embodiments given in conjunction with the accompanying drawings, in which.

DESCRIPTION OF SPECIFIC EMBODIMENTS

Figure 1:
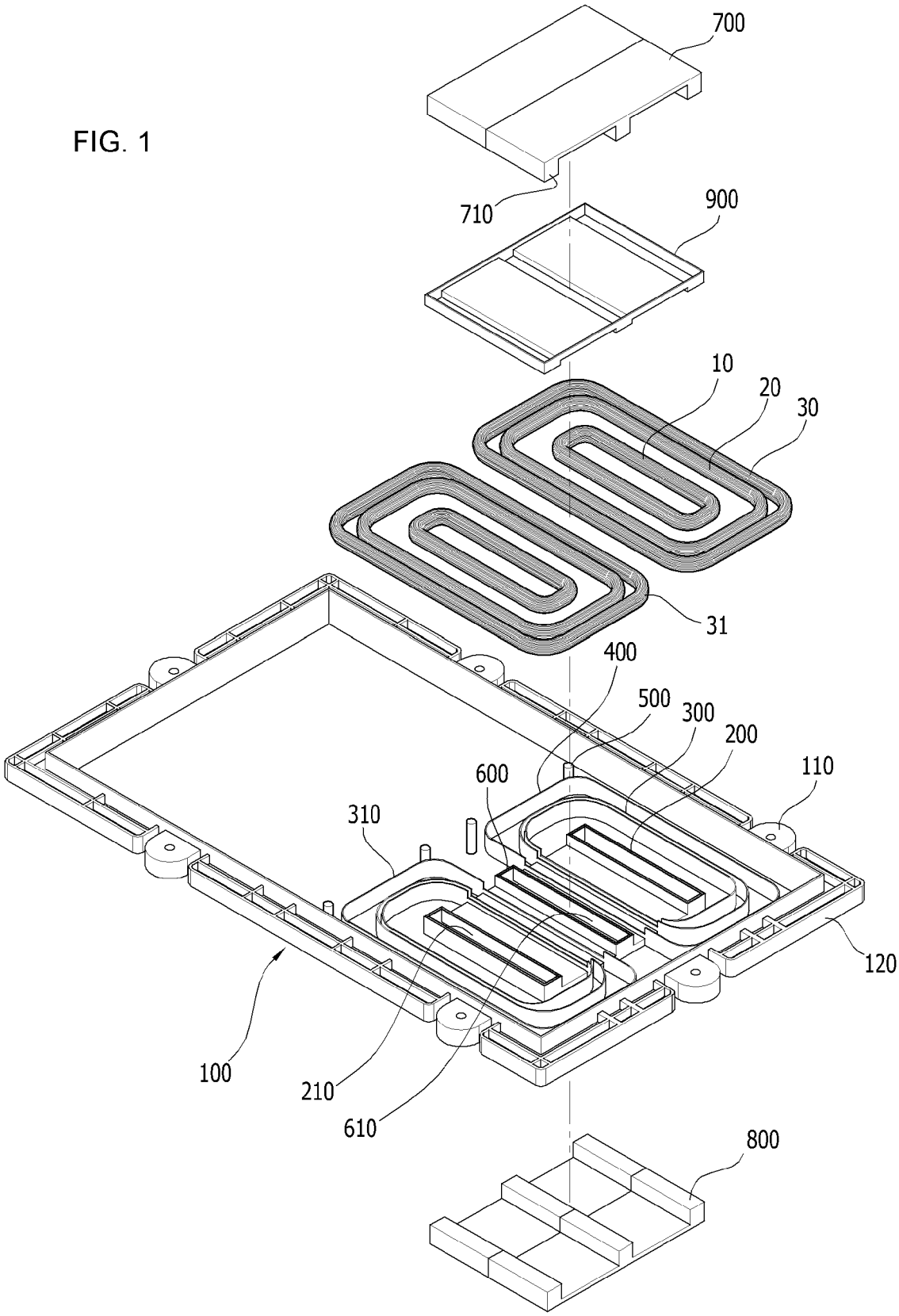
FIG. 1 is an exploded perspective view briefly showing the configuration of a slim-type high voltage transformer according to a embodiment of the present invention.

Exemplary embodiments now will be described more fully hereinafter with reference to the accompanying drawings, in which exemplary embodiments are shown. This disclosure may, however, be embodied in many different forms and should not be construed as limited to the exemplary embodiments set forth therein. Rather, these exemplary embodiments are provided so that this disclosure will be thorough and complete, and will fully convey the scope of this disclosure to those skilled in the art. In the description, details of well-known features and techniques may be omitted to avoid unnecessarily obscuring the presented embodiments. In the drawings, like reference numerals in the drawings denote like elements, and their overlapping descriptions will be omitted. The shape, size and regions, and the like, of the drawing may be exaggerated for clarity.

FIG. 1 is an exploded perspective view briefly showing the configuration of a slim-type high voltage transformer according to a embodiment of the present invention.

Figure 3:
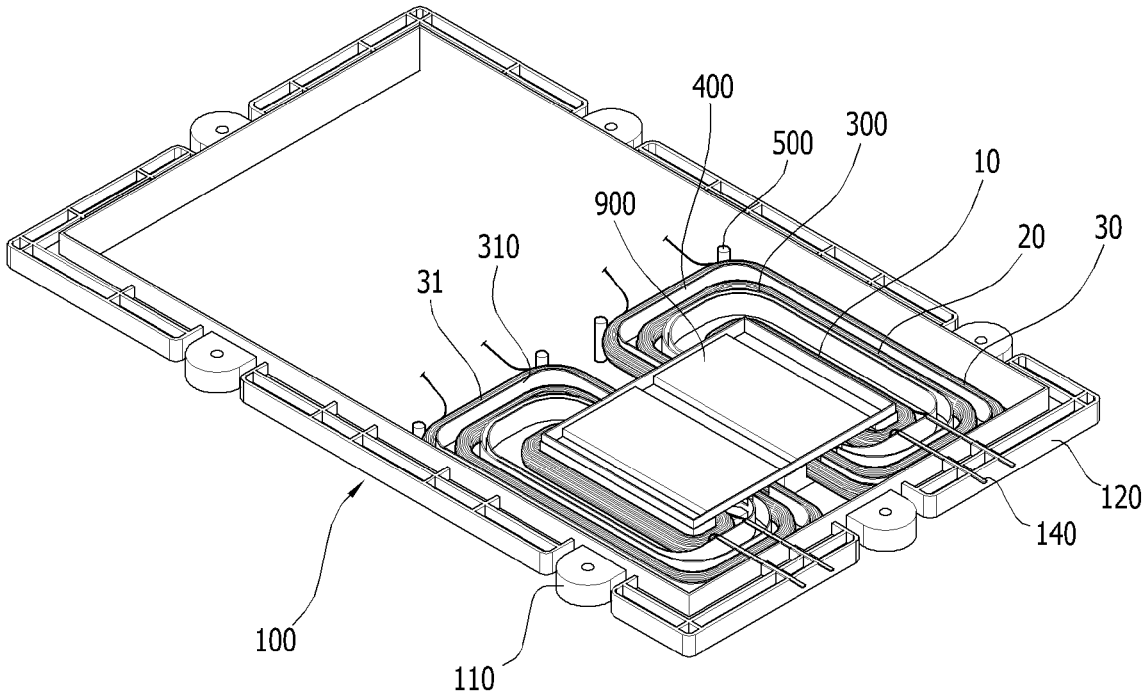
FIG. 3 is a perspective view showing a state that an insulating member for insulating the primary and secondary winding coils from a copperplate core is mounted on the primary and secondary winding coils according to a embodiment of the present invention.
Figure 4:
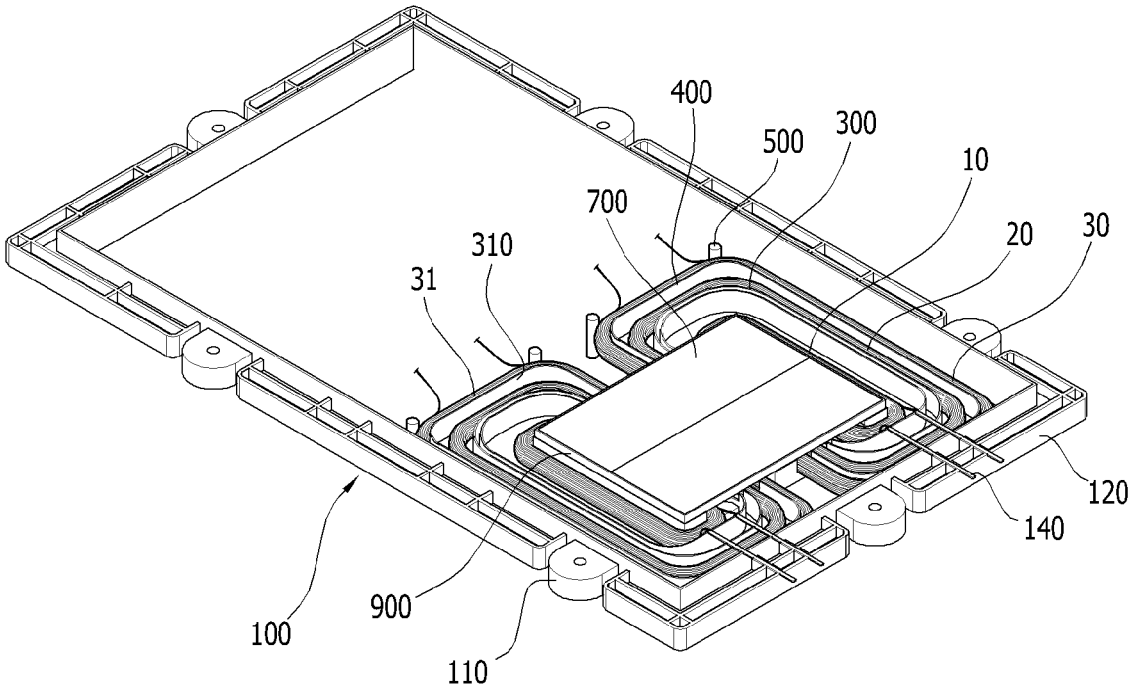
FIG. 4 is a perspective view showing a state that the copperplate core is mounted on the primary and secondary winding coils with the insulating member interposed therebetween according to a embodiment of the present invention.

As shown in FIG. 1, the slim-type high voltage transformer according to the fifth embodiment of the present invention is provided with a case 100 and a plurality of transformer portions. The transformer portions include first protruding grooves 200, first isolating partition walls 300, second isolating partition walls 400, fixing projections 500, a second protruding groove 600, first and second copperplate cores 700 and 800 and an insulating portion 900. The plurality of transformer portions are disposed bilaterally symmetric in the case 100, and share the first copperplate core 700 and the insulating member 900 as shown in FIGS. 3 and 4.

The case 100 is a plastic injection molded product. At least one semicircular projection 110 to be fixed by a bolt is formed at each side of the case 100, and a "¬" shaped outer wall 120 is formed at each corner of the case 100, considering the thermal resistance and tensile strength of the product in molding. The interior of the case 100, in which components are mounted, is molded with a molding material including an epoxy or urethane resin to which a thermal resistant resin is added.

Figure 5:
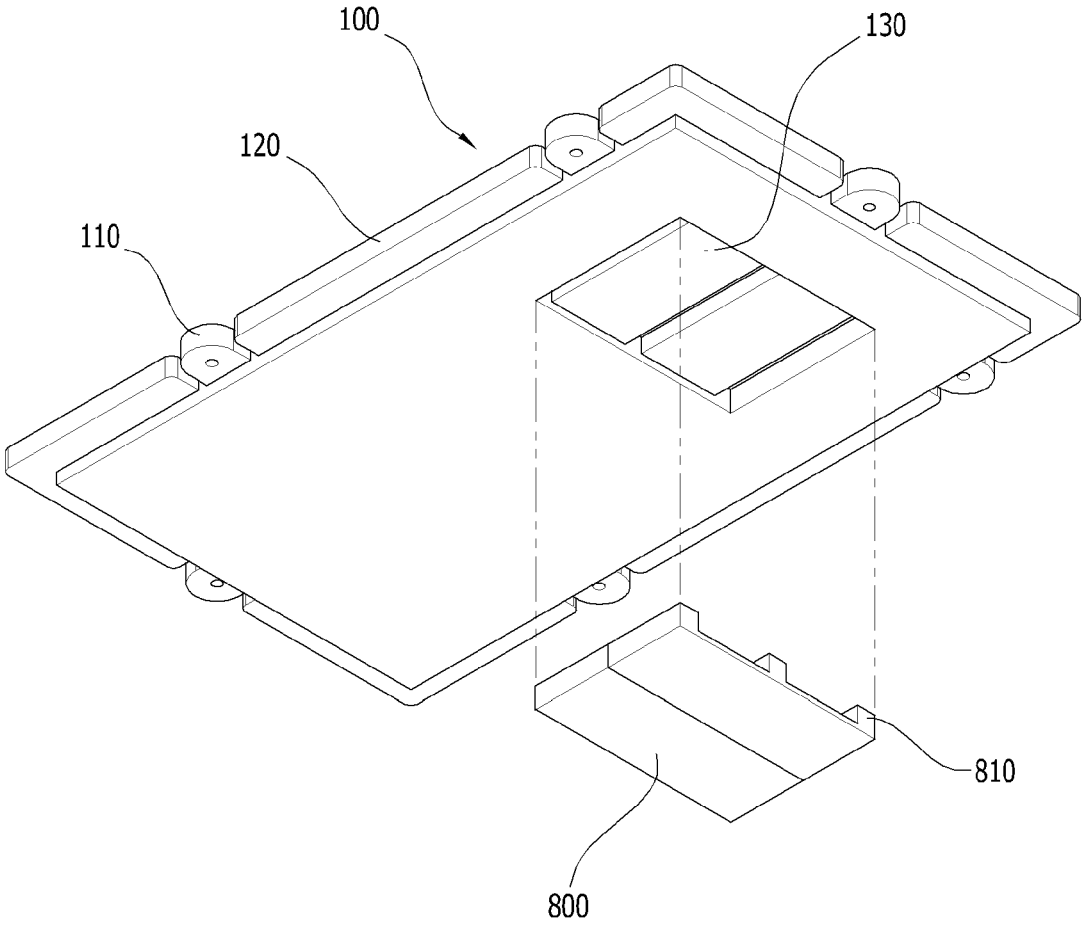
FIG. 5 is a bottom view of the case of the slim-type high voltage transformer according to a embodiment of the present invention.
Figure 6:
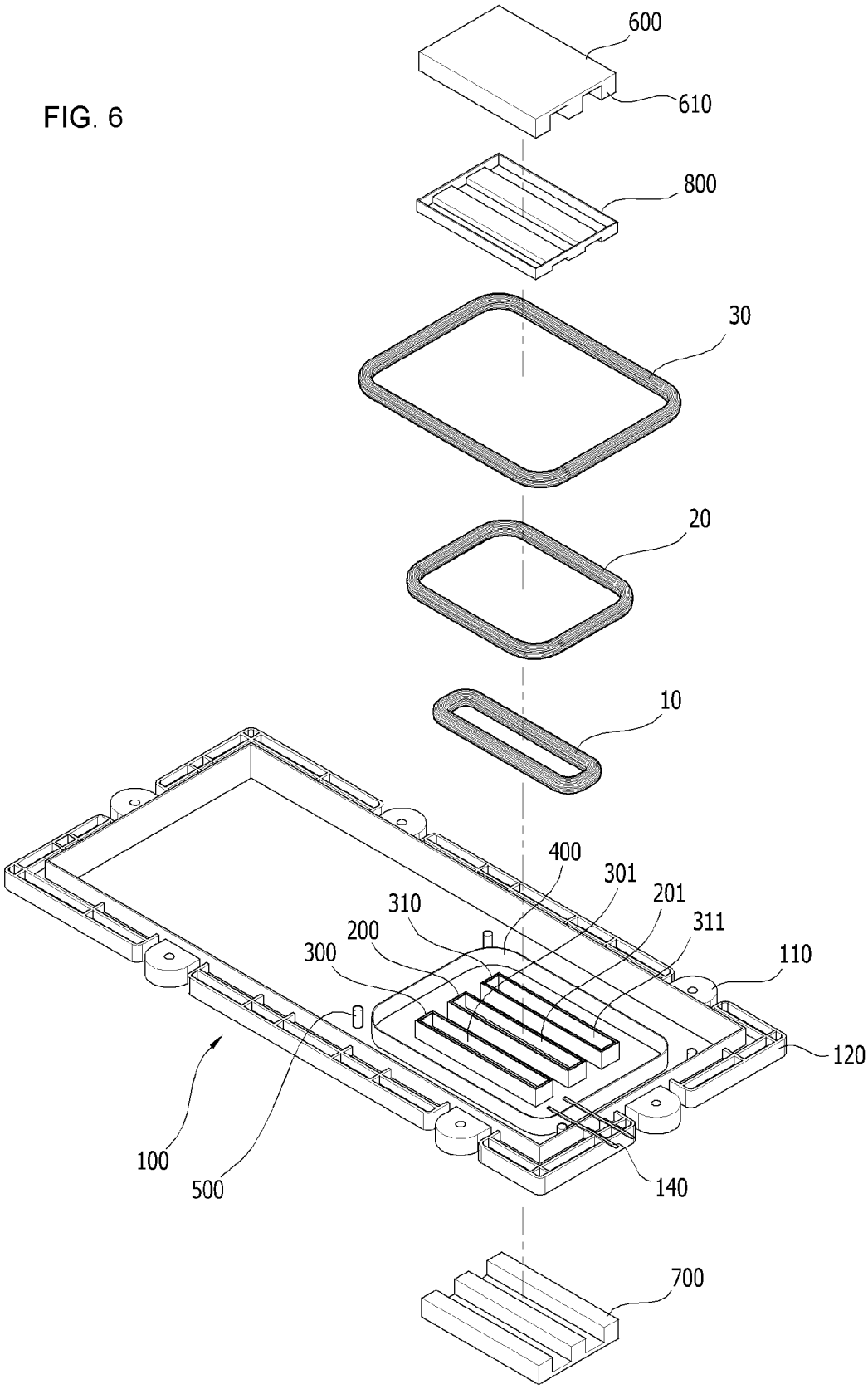
FIG. 6 is another exploded perspective view briefly showing the configuration of a slim-type high voltage transformer according to an embodiment of the present invention.

As shown in FIG. 5, the case 100 has an accommodating groove 130 formed at a bottom surface thereof. Here, the accommodating groove 130 accommodates the second copperplate core 800 that constitutes a pair with the first copperplate core 700.

Each of the first protruding grooves 200 is formed to mount a primary winding coil 10 wound in the shape of a rectangular or elliptic track in the interior of the case 100.

Each of the first isolating partition walls 300 is formed to insulate a secondary winding coil 20 mounted at an outer circumference of the primary winding coil 10 from the primary winding coil 10. Here, the secondary winding coil 20 is wound in the shape of a rectangular or elliptic track in the interior of the case 100.

Each of the second isolating partition wall 400 is formed at the outside of the first isolating partition wall 300 so as to insulate the secondary winding coil 20 from a secondary winding coil 30.

In this instance, the mounted primary and secondary winding coils 10, 20 and 30 are wound so that their diameters are increased in the order of the primary winding coil 10<the secondary winding coil 20<the secondary winding coil 30.

The fixing projections 500 are formed so that the mounted secondary winding coil 30 is adhered and fixed to the second isolating partition wall 400.

The second protruding groove 600 is formed for the purpose of insulation between the two transformer portions.

The first and second copperplate cores 700 and 800 are "E" shaped cores. The first and second copperplate cores 700 and 800 are used to make the shape of a magnetic field according to magnetic induction, and a closed circuit is formed about an intermediate core. In this instance, the loss due to eddy current is prevented by using a plurality of copperplate cores.

As shown in FIG. 3, the insulating member 900 is interposed between the first protruding groove 200 and the first copperplate core 700 to insulate the primary and secondary winding coils 10, 20 and 30 and the first copperplate core 700.

The first protruding groove 200 and the second protruding groove 600 are provided with through-holes 210 and 610 respectively coupled to convex grooves 710 formed on the bottom surface of the first copperplate core 700. The insulating member 900 is provided with a plurality of through-holes (not shown) so that the convex grooves 710 of the first copperplate core 700 are coupled to the through-holes 210 and 610, respectively.

In this instance, the through-holes 210 and 610 are formed so that their halls are extended to the accommodating groove 130 at a bottom surface of the case 100.

Meanwhile, the case 100 further includes a conducting member 140 attached to one side of the case 100 or the primary winding coil 10. The conducting member 140 is electrically connected to a wire (not shown) extended to the primary winding coil 10 from the exterior thereof. The conducting member 140 and the primary winding coil 10 are wire-bonded to each other.

The secondary winding coils 20 and 30 are wire-bonded to a voltage distribution portion (not shown) mounted at a specific position in the case 100. Here, the voltage distribution portion functions to rectify AC boosted in the transformer portion to DC and to output high voltage.

Hereinafter, a manufacturing process of the slim-type high voltage transformer according to the fifth embodiment of the present invention will be described in detail with reference to the drawings.

Figure 2:
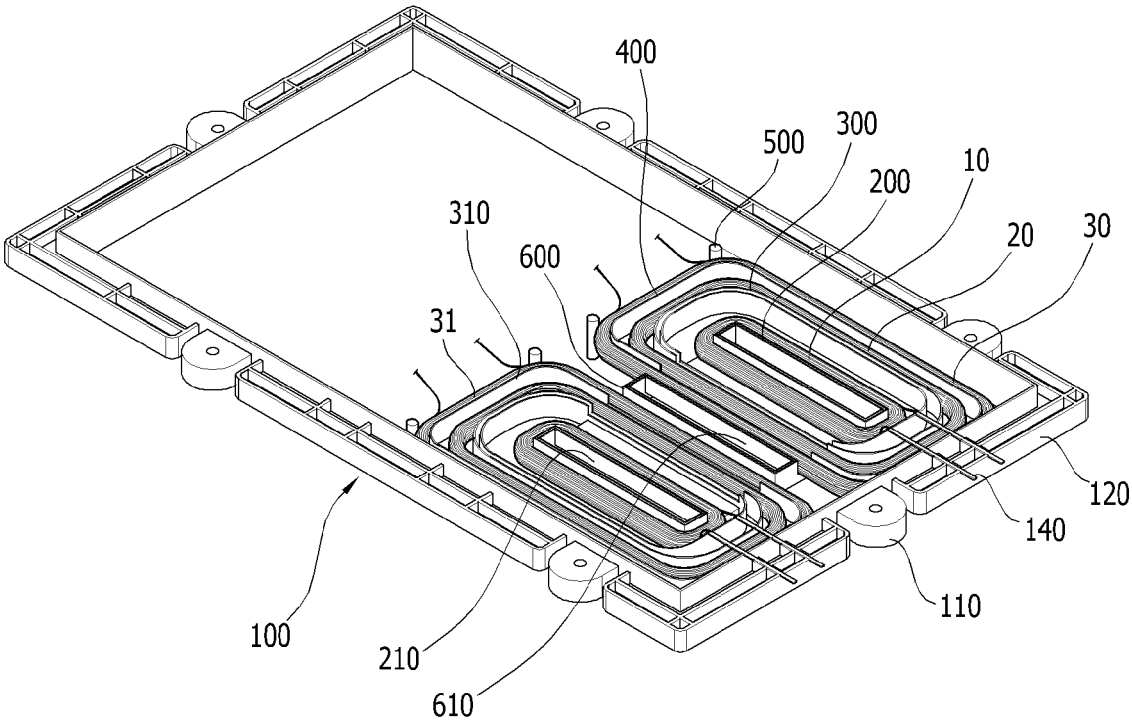
FIG. 2 is a perspective view showing a state that primary and secondary winding coils are mounted in a case according to a embodiment of the present invention.

FIG. 2 is a perspective view showing a state that primary and secondary winding coils are mounted in a case according to a fifth embodiment of the present invention.

As shown in FIG. 2, the first protruding groove 200, the first isolating partition wall 300, the second isolating partition wall 400, the fixing projections 500 and the second protruding groove 600 are previously formed in the interior of the case 100.

Subsequently, the primary winding coil 10 wound in the shape of the rectangular or elliptic track is mounted to the first protruding groove 200 previously formed in the interior of the case 100, and the secondary winding coil 20 wound in the shape of the rectangular or elliptic track is mounted to the first isolating partition wall 300 formed to the outside of the first protruding groove 200. Then, the secondary winding coil 30 wound in the shape of the rectangular or elliptic track is mounted between the second isolating partition wall 400 and the fixing projections 500. In this instance, the primary and second winding coils 10, 20 and 30 are not dispersed but maintain their wound shape even after they are wound in the shape of the rectangular or elliptic track.

If the mounting of the primary and secondary winding coils 10, 20 and 30 is completed, the insulating member 900 is coupled to the first and second protruding grooves 200 and 600, and the first copperplate core 700 is mounted on the insulating member 900, so that the primary and secondary winding coils 10, 20 and 30 are insulated from the first copperplate core 700.

In this instance, the second copperplate core 800 is accommodated in the accommodating groove 130 to be connected to the first copperplate core 700 through the through-holes 210 and 610 of the first and second protruding grooves 200 and 600.

Subsequently, the primary winding coil 10 is wire-bonded to the conducting member 140 to be connected to an external wire, and the secondary winding coils 20 and 30 are wire-bonded to the voltage distribution portion mounted at the specific position in the case 100.

Meanwhile, if the mounting of all the components is finished, the interior of the case 100 is molded with a molding material including an epoxy or urethane resin to which a thermal resistant resin is added, and the case 100 is then covered by a cover (not shown), thereby sealing the case 100.

While the disclosure has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A slim-type high voltage transformer comprising:

a case; and a plurality of transformer portions configured by mounting a plurality of primary and secondary winding coils to protruding grooves formed substantially on a plane in the interior of the case and then mounting a copperplate core on the primary and secondary winding coils, wherein the copperplate core comprises "E" shaped convex grooves, wherein the plurality of transformer portions are disposed bilaterally symmetric substantially on the plane, and share at least one of the "E" shaped convex grooves of the copperplate core and an insulating member interposed between the primary and secondary winding coils and the copperplate core, wherein the case is a plastic injection molded product and further comprises a conducting member attached to a side of the primary winding coil, and the conducting member is electrically connected to a wire extended to the primary winding coil from the exterior of the case.

2. The transformer according to claim 1, wherein the plurality of transformer portions are configured by mounting one secondary winding coil wound in the shape of a rectangular or elliptical track at the interior of the case, mounting another secondary winding coil having the same shape as but a smaller diameter than the one secondary winding coil in the inside of the one secondary winding coil and then mounting a primary winding coil having the same shape as but a smaller diameter than the another secondary winding coil at the interior of the another secondary winding coil.

3. The transformer according to claim 1, wherein the plurality of transformer portions comprise:

first protruding grooves each formed in the interior of the case to mount a primary winding coil wound in the shape of a rectangular or elliptic track thereto;

first isolating partition walls each formed to insulate secondary winding coils mounted at an outer circumference of the primary winding coil from the primary winding coil;

second isolating partition walls each formed at an outside of the first isolating partition wall for the purpose of insulation between the secondary winding coils;

a plurality of fixing projections formed so that the secondary winding coil mounted to the second isolating partition wall is adhered and fixed to the second isolating partition wall; and a second protruding groove formed to insulate the plurality of transformer portions from each other.

4. The transformer according to claim 3, wherein the first and second protruding grooves are provided with first through-holes coupled to convex grooves formed at the bottom surface of a first copperplate core, respectively, the insulating member is provided with a plurality of second through-holes through which the convex grooves of the copperplate core are coupled to the first through-holes, respectively, and the case is provided with an accommodating groove for accommodating a second copperplate core that constitutes a pair with the copperplate core at a bottom surface thereof.

5. The transformer according to claim 1, wherein the interior of the case, in which components are mounted, is molded with a molding material including an epoxy or urethane resin to which a thermal resistant resin is added.

6. The transformer according to claim 1, wherein the case is provided with at least one semicircular projection to be fixed by a bolt is formed at each side of the case, and a "L" shaped outer wall is formed at each corner of the case, considering the thermal resistance and tensile strength of the product in molding.

* * * * *